US011480060B2

(12) United States Patent
Galoul et al.

(10) Patent No.: US 11,480,060 B2
(45) Date of Patent: Oct. 25, 2022

(54) TURBOMACHINE COMPONENT FOR A GAS TURBINE, TURBOMACHINE ASSEMBLY AND GAS TURBINE HAVING THE SAME

(71) Applicant: DOOSAN HEAVY INDUSTRIES & CONSTRUCTION CO., LTD., Changwon-si (KR)

(72) Inventors: Vincent Galoul, Baden (CH); Simon Hauswirth, Baden (CH); Richard Jones, Baden (CH)

( * ) Notice: Subject to any disclaimer, the term of this patent is extended or adjusted under 35 U.S.C. 154(b) by 0 days.

(21) Appl. No.: 17/149,079

(22) Filed: Jan. 14, 2021

(65) Prior Publication Data

US 2021/0277784 A1 Sep. 9, 2021

(51) Int. Cl.
*F01D 5/18* (2006.01)
*F01D 9/06* (2006.01)

(52) U.S. Cl.
CPC ..... *F01D 5/189* (2013.01); *F01D 9/065* (2013.01); *F05D 2240/126* (2013.01); *F05D 2240/304* (2013.01); *F05D 2240/81* (2013.01); *F05D 2250/75* (2013.01); *F05D 2260/201* (2013.01); *F05D 2260/232* (2013.01)

(58) Field of Classification Search
None
See application file for complete search history.

(56) References Cited

U.S. PATENT DOCUMENTS 5,591,002 A * 1/1997 Cunha ..... F01D 5/187 415/115
6,283,708 B1 * 9/2001 Zelesky ..... F01D 5/189 416/97 R
8,777,569 B1 * 7/2014 Liang ..... F01D 5/188 416/96 A
9,581,028 B1 * 2/2017 Jones ..... B33Y 80/00
10,711,620 B1 * 7/2020 Berry ..... F01D 5/189
(Continued)

FOREIGN PATENT DOCUMENTS

DE 69206556 T2 3/1993
JP H05195705 A 8/1993

OTHER PUBLICATIONS

DE OA dated Dec. 14, 2020.
KR OA dated Jun. 30, 2022.

*Primary Examiner* — Michael Lebentritt
(74) *Attorney, Agent, or Firm* — Harvest IP Law, LLP

(57) ABSTRACT

The present technique presents a turbomachine component having an airfoil e.g. a vane of a gas turbine. The airfoil wall defines an internal space which includes a first and a second cooling channels having a first and a second impingement inserts, that define a first main and a first peripheral flow channels in the first cooling channel and a second main and a second peripheral flow channels in the second cooling channel, respectively. Impingement jets ejected from the main flow channels via impingement holes of the corresponding impingement inserts are received in the corresponding peripheral flow channels. A channel connecting conduit conducts a flow of the cooling air from the first cooling channel to the second cooling channel. The channel connecting conduit includes an inlet connected to an outlet of the first cooling channel, and an outlet connected to an inlet of the second cooling channel.

20 Claims, 9 Drawing Sheets

(56) References Cited

U.S. PATENT DOCUMENTS

| | | | | |
|---|---|---|---|---|
| 2003/0049127 | A1* | 3/2003 | Tiemann | F01D 5/189 416/97 R |
| 2003/0170113 | A1 | 9/2003 | Burdgick | |
| 2004/0062649 | A1* | 4/2004 | Schopf | F01D 5/189 416/97 R |
| 2010/0054915 | A1* | 3/2010 | Devore | F01D 5/189 415/116 |
| 2010/0054932 | A1* | 3/2010 | Schiavo | F01D 5/147 415/200 |
| 2010/0166564 | A1* | 7/2010 | Benjamin | F01D 5/188 416/223 R |
| 2010/0221123 | A1* | 9/2010 | Pal | F01D 5/189 416/97 R |
| 2010/0247290 | A1* | 9/2010 | Hada | F01D 5/189 415/115 |
| 2012/0107134 | A1* | 5/2012 | Harris, Jr. | F01D 5/18 416/97 R |
| 2014/0105726 | A1* | 4/2014 | Lee | F01D 5/188 415/115 |
| 2014/0348636 | A1* | 11/2014 | Buhler | F01D 9/02 415/115 |
| 2016/0362985 | A1* | 12/2016 | Lacy | F01D 5/147 |
| 2017/0234154 | A1* | 8/2017 | Downs | F01D 9/065 415/177 |
| 2018/0045059 | A1* | 2/2018 | Lee | F01D 5/187 |
| 2018/0066523 | A1* | 3/2018 | Marsh | F01D 25/12 |
| 2018/0163555 | A1* | 6/2018 | Snider | F01D 5/18 |
| 2018/0230814 | A1* | 8/2018 | Spangler | F01D 5/186 |
| 2020/0024966 | A1* | 1/2020 | Craig, III | B22F 10/00 |
| 2021/0254477 | A1* | 8/2021 | Galoul | F01D 5/189 |

* cited by examiner

TURBOMACHINE COMPONENT FOR A GAS TURBINE, TURBOMACHINE ASSEMBLY AND GAS TURBINE HAVING THE SAME

CROSS-REFERENCE TO RELATED APPLICATION(S)

This application claims priority to German Patent Application No. 10 2020 106 135.8 filed on Mar. 6, 2020 the disclosure of which is incorporated herein by reference in its entirety.

BACKGROUND OF THE INVENTION

Field of the Invention

The present invention relates to gas turbines, and more particularly to cooling of airfoils of gas turbines.

Description of the Related Art

Turbomachines include various turbomachine components that benefit from cooling, resulting into increased operational life of the components. By cooling of turbomachine components an increase in efficiency of the turbomachine is also realized.

Certain turbomachine components have an airfoil, e.g. a blade or a vane. The airfoils enclose internal spaces and are cooled internally or from the inside by flowing cooling air through the internal space of the airfoil or through one or more cooling channels formed in the internal space of the airfoil.

The turbomachine component—hereinafter also referred to as the blade or vane—generally comprises of the airfoil (also referred to as an aerofoil) which extends along a longitudinal direction of the airfoil protruding from a platform. During operation of the gas turbine, the airfoil of the blade or the vane of the turbine section of the gas turbine are positioned in the hot gas path and are subjected to very high temperatures. The airfoils include pressure and suction sides that meet at leading and trailing edges and define the internal space of the airfoil. The airfoil also includes one or more webs that extend from the pressure side to suction side and thereby mechanically reinforce the pressure side and the suction side. The web, depending on the number of webs, divides the internal space of the airfoil into one or more cooling channels that extend along the longitudinal direction of the airfoil. Cooling air generally flows along the longitudinal direction of the airfoil in such cooling channels after being introduced into the airfoil. Enhancement of such internal cooling of the airfoil will have beneficial effect on the efficiency of the gas turbine and/or on structural integrity of the airfoil.

It is commonly known to use impingement cooling of an inner surface of the airfoil, for example by using impingement inserts in the cooling channels. The impingement inserts divide the cooling channel longitudinally to define, within the cooling channel, a main flow channel and a peripheral flow channel. The main flow channel is for conducting flow of cooling air along a longitudinal direction of the airfoil; and the peripheral flow channel is for receiving impingement jets ejected from the main flow channel via impingement holes of the impingement inserts. The impingement jets are directed to the airfoil wall, however the impingement jets experience considerable cross-flows that develop in the peripheral flow channel, thereby reducing the cooling efficiency of the target surface.

Furthermore, for cooling of components of the gas turbine, a part of the air from the compressor section of the gas turbine is withdrawn and used as cooling air, and is flowed to different parts of the gas turbine which may be at different distances. For achieving proper flow of the cooling air, the cooling air flow must be maintained at optimal pressures in different regions of the turbomachine, and also within different regions of turbomachine components. Also, for efficient impingement cooling maintenance of optimal pressures is important, primarily to provide enough pressure to the impingement jets so as to be able to impinge on the target surface, counteracting any neighboring cross-flows. However, increase in an amount of air withdrawn from the compressor for cooling results in decrease in the amount of air available for combustion which may adversely affect the efficiency of the gas turbine. Therefore, it would be beneficial if cooling air that has been used once, e.g. for impingement cooling of a first surface, is reused for cooling another surface say a second surface, for example by being re-used to form impingement jets that can impinge on the second surface.

Therefore, it is advantageous to enhance internal cooling of the airfoil.

SUMMARY OF THE INVENTION

The above objects are achieved by the features of the independent claims, preferably by a turbomachine component for a gas turbine. Advantageous embodiments of the present technique are provided in dependent claims.

Such turbomachine components that include an airfoil are exemplified hereinafter by a vane, however the description is also applicable to other turbomachine components that include an airfoil such as a blade, unless otherwise specified.

In a first aspect of the present technique, a turbomachine component for a gas turbine is presented.

The turbomachine component includes an airfoil comprising an airfoil wall. The airfoil wall defines an internal space of the airfoil. The airfoil further includes a first cooling channel and a second cooling channel—each defined within the internal space of the airfoil.

The turbomachine component includes a first impingement insert inserted in the first cooling channel. The first impingement insert defines, within the first cooling channel, a first main flow channel and at least one first peripheral flow channel. The first main flow channel is for conducting flow of cooling air along a longitudinal direction of the airfoil. The at least one first peripheral flow channel is for receiving impingement jets ejected from the first main flow channel via impingement holes of the first impingement insert. The impingement jets may be directed to the airfoil wall.

The turbomachine component includes a second impingement insert inserted in the second cooling channel. The second impingement insert defines, within the second cooling channel, a second main flow channel and at least one second peripheral flow channel. The second main flow channel is for conducting flow of cooling air along the longitudinal direction of the airfoil. The at least one second peripheral flow channel is for receiving impingement jets ejected from the second main flow channel via impingement holes of the second impingement insert.

The turbomachine component includes a channel connecting conduit configured to conduct a flow of the cooling air from the first cooling channel to the second cooling channel. The channel connecting conduit includes an inlet connected to an outlet of the first cooling channel. The channel connecting conduit includes an outlet connected to an inlet of the second cooling channel.

The channel connecting conduit is a separate part and is not part of the airfoil walls generally, and particularly are not part of the airfoil walls, external wall or primary wall or internal wall or wall of the webs, that define the cooling channels. The channel connecting conduit is a separate part and is also not part of the impingement inserts.

The inlet of the channel connecting conduit may encompasses an outlet of the first peripheral flow channel only, i.e. without encompassing an outlet of the first main flow channel. In other words, the cooling air flowing out of the outlet of the first peripheral flow channel flows into the inlet of the channel connecting conduit, but flowing out of the outlet of the first main flow channel may or may not flow into the inlet of the channel connecting conduit.

An outlet of the first main flow channel may be sealed, e.g. completely sealed, for completely stopping flow of cooling air out of the outlet of the first main flow channel into the channel connecting conduit. The sealing may be achieved by a sealing cap. The sealing cap may be disposed inside the first main flow channel or at the outlet of the first main flow channel inside or outside the first main flow channel.

An outlet of the first main flow channel may be sealed, e.g. partially sealed, for partially stopping flow of cooling air out of the outlet of the first main flow channel into the channel connecting conduit. The partial sealing may be achieved by a sealing cap which partially blocks the first main flow channel. The sealing cap may be disposed inside the first main flow channel or at the outlet of the first main flow channel inside or outside the first main flow channel.

An outlet of the first main flow channel may be sealed, e.g. partially sealed, for partially stopping flow of cooling air out of the outlet of the first main flow channel into the channel connecting conduit. The partial sealing may be achieved by a sealing cap comprising one or more through holes. The sealing cap may be disposed inside the first main flow channel or at the outlet of the first main flow channel inside or outside the first main flow channel. The one or more through-holes allow flow of cooling air of the first main flow channel into the channel connecting conduit.

The sealing cap, with or without the through holes, functions to build up pressure inside the first main flow channel to facilitate formation of the impingement jets ejected from the first main flow channel via impingement holes of the first impingement insert.

The inlet of the channel connecting conduit may encompasses or cover each of an outlet of the first main flow channel and an outlet of the first peripheral flow channel. In other words, the cooling air flowing out of the outlet of the first main flow channel and the outlet of the first peripheral flow channel flows into the inlet of the channel connecting conduit.

The outlet of the channel connecting conduit may encompass an inlet of the second main flow channel without encompassing an inlet of the second peripheral flow channel. In other words, the cooling air flowing from the outlet of the first main flow channel and the outlet of the first peripheral flow channel into the inlet of the channel connecting conduit may flow, via the channel connecting conduit, only into the inlet of the second main flow channel.

To explain further, the cooling air flowing from the outlet of the first main flow channel and the outlet of the first peripheral flow channel into the inlet of the channel connecting conduit may not flow, via the channel connecting conduit, into the inlet of the second peripheral flow channel.

It can be understood also as that the inlet of the channel connecting conduit may be connected to both the outlet of the first main flow channel and the outlet of the first peripheral flow channel so as to receive the cooling air from both the first main flow channel and the first peripheral flow channel, however the outlet of the channel connecting conduit may be connected only to the inlet of the second main flow channel, so as to deliver or feed the cooling air, received from both the first main flow channel and the first peripheral flow channel, into only the second main flow channel, and not into the second peripheral flow channel.

The inlet of the second peripheral flow channel may be sealed. For example, a flange protruding out of an outer surface of the second impingement insert may be configured to close or to seal the inlet of the second peripheral flow channel.

The airfoil wall may include a pressure side and a suction side meeting at a leading edge and a trailing edge and defining an internal space of the airfoil.

The airfoil may include at least one web disposed within the internal space of the airfoil and extending between the pressure side and the suction side.

The first cooling channel and/or the second cooling channel may be defined by the at least one web and the pressure side and/or the suction side.

The turbomachine component may include a platform from which the airfoil extends. The inlet and the outlet of the channel connecting conduit, the outlet of the first cooling channel, and the inlet of the second cooling channel are arranged at the platform.

The turbomachine component may include a seal ring configured to be positioned between the inlet of the channel connecting conduit and the outlet of the first cooling channel.

The channel connecting conduit may include a bent portion having a U-shape between the inlet and the outlet of the channel connecting conduit. The cooling air received into the inlet of the channel connecting conduit may flow out only from the outlet of the channel connecting conduit.

The channel connecting conduit may include an extension portion extending horizontally from the outlet of the channel connecting conduit in a direction opposite to the inlet of the channel connecting conduit. The second impingement insert may include a receiving portion. The receiving portion may have a shape corresponding to or complementary to the extension portion. The receiving portion and the extension portion are configured to be mechanically coupled to each other.

The second cooling channel may be located at the trailing edge of the airfoil.

The first cooling channel may be located between the leading edge of the airfoil and the trailing edge of the airfoil, with respect to a camber line of the airfoil.

The turbomachine component may be vane of a gas turbine.

The turbomachine component may be blade of a gas turbine.

In a second aspect of the present technique, a turbomachine assembly is presented. The turbomachine assembly may include at least one turbomachine component according to the first aspect of the present technique as described hereinabove, amongst a plurality of turbomachine components. An example of the turbomachine assembly may be a vane assembly or a vane stage. The vane assembly or the vane stage may be disposed in the turbine section of the gas turbine.

In a third aspect of the present technique, a gas turbine is presented. The gas turbine includes a turbomachine assembly. The turbomachine assembly may be according to the above-described second aspect of the present technique.

The turbomachine assembly may be positioned in a turbine section of the gas turbine.

The turbine section may include an inner casing and an outer casing defining thereinbetween at least a section of a hot gas path. The hot gas path may generally be annular in shape. The inner casing may be disposed radially inwards of the outer casing.

The turbomachine component may be a vane which is connected to or arranged at the inner and the outer casings. The airfoil of the vane may be disposed in the section of the hot gas path.

The outlet of the first cooling channel, the inlet of the second cooling channel and the channel connecting conduit may be positioned radially inwards of the airfoil at the inner casing.

Alternatively, the outlet of the first cooling channel, the inlet of the second cooling channel and the channel connecting conduit may be positioned radially outwards of the airfoil at the outer casing.

Alternatively, the gas turbine may have at least two channel connecting conduits. One, say a first channel connecting conduit, of the at least two channel connecting conduits, along with the outlet of the first cooling channel and the inlet of the second cooling channel to which the first channel connecting conduit is connected, may be positioned radially inwards of the airfoil at the inner casing; and another, say a second channel connecting conduit, of the at least two channel connecting conduits, along with the outlet of the first cooling channel and the inlet of the second cooling channel to which the second channel connecting conduit is connected, may be positioned radially outwards of the airfoil at the outer casing.

It may be noted that in the present technique, 'inlet' and 'outlet' are used with respect to flow of the cooling air i.e. inlet means inlet for cooling air and outlet means outlet for cooling air, unless otherwise specified.

By using in the second cooling channel, the cooling air which has already been used in the first peripheral flow channel to form impingement jets is re-used, which is beneficial for cooling as well as for increasing efficiency of the gas turbine.

Furthermore, when the cooling air flowing from the outlet of the first main flow channel and the outlet of the first peripheral flow channel into the inlet of the channel connecting conduit may only flow, via the channel connecting conduit, into the inlet of the second main flow channel, the cooling air is re-used to form impingement jets via the impingement holes of the second impingement insert. Also, stronger impingement jets may be ejected via the impingement holes of the second impingement insert, which increase cooling efficiency generally and which also tackles the effect of surrounding cross-flows in the second peripheral flow channel.

Also, since the cooling air flowing from the outlet of the first main flow channel and the outlet of the first peripheral flow channel into the inlet of the channel connecting conduit may not flow, via the channel connecting conduit, into the inlet of the second peripheral flow channel, the effect of cross-flow that may develop due to cooling air entering the second peripheral flow channel at its inlet, is obviated.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DESCRIPTION OF SPECIFIC EMBODIMENTS

Figure 1:
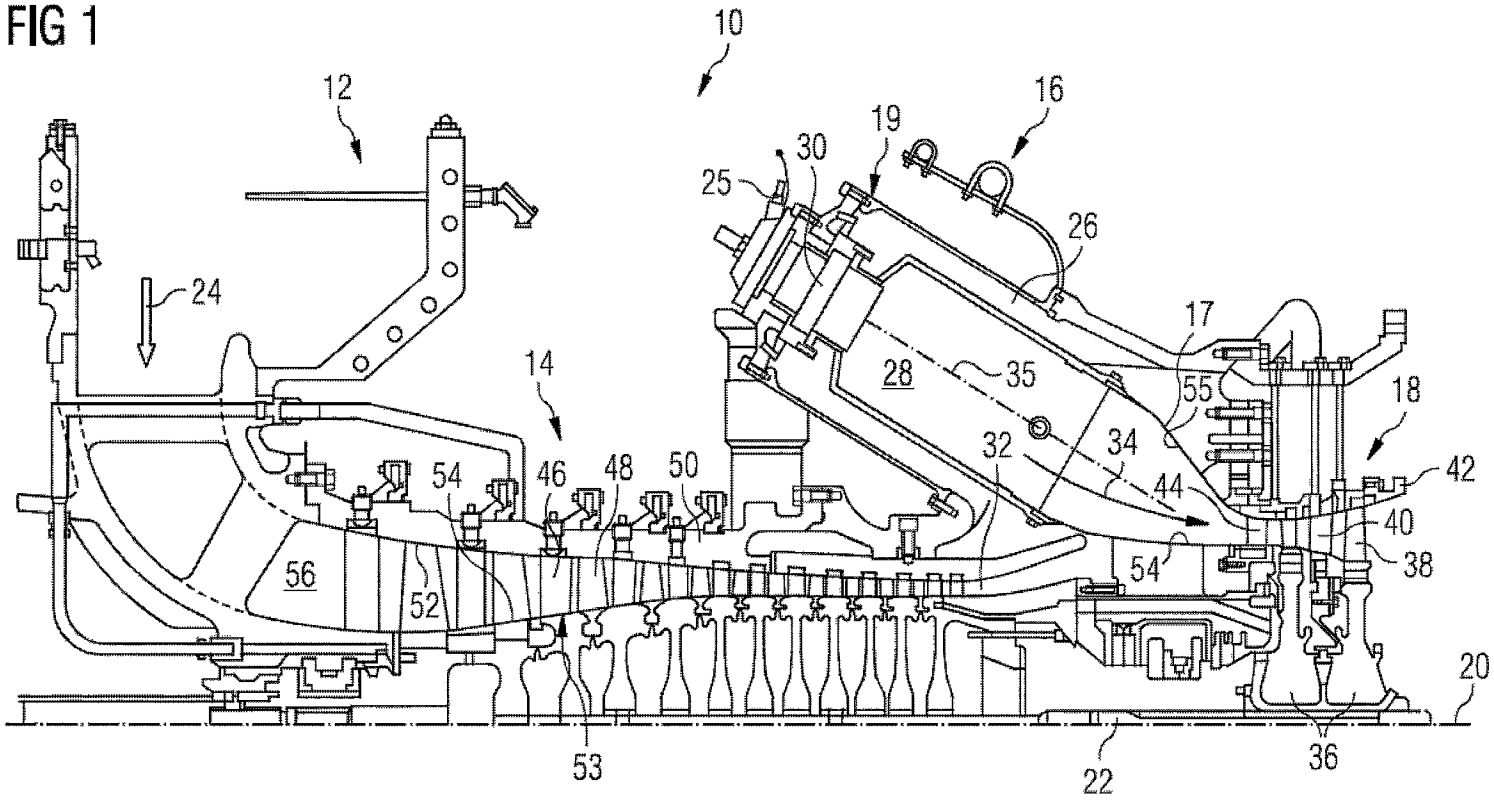
FIG. 1 shows part of a gas turbine in a sectional view and in which a turbomachine component of the present technique is incorporated.

Hereinafter, above-mentioned and other features of the present technique are described in detail. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine 10 in a sectional view. The gas turbine 10 may comprises, in flow series, an inlet 12, a compressor or compressor section 14, a combustor section 16 and a turbine section 18 which are generally arranged in flow series and generally about and in the direction of a longitudinal or rotational axis 20. The gas turbine 10 may further comprises a shaft 22 which is rotatable about the rotational axis 20 and which extends longitudinally through the gas turbine 10. The shaft 22 may drivingly connect the turbine section 18 to the compressor section 14.

In operation of the gas turbine 10, air 24, which is taken in through the air inlet 12 is compressed by the compressor section 14 and delivered to the combustion section or burner section 16. The burner section 16 may comprise a burner plenum 26, one or more combustion chambers 28 and at least one burner 30 fixed to each combustion chamber 28. The combustion chambers 28 and the burners 30 may be located inside the burner plenum 26. The compressed air passing through the compressor 14 may enter a diffuser 32 and may be discharged from the diffuser 32 into the burner plenum 26 from where a portion of the air may enter the burner 30 and is mixed with a gaseous or liquid fuel. The air/fuel mixture is then burned and the combustion gas 34 or working gas from the combustion is channeled through the combustion chamber 28 to the turbine section 18 via a transition duct 17.

This exemplary gas turbine 10 may have a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets may form an annulus for channeling the combustion gases to the turbine 18.

The turbine section 18 may comprise a number of blade carrying discs 36 attached to the shaft 22. In the present example, two discs 36 each carry an annular array of turbine blades 38 are depicted. However, the number of blade carrying discs could be different, i.e. only one disc or more than two discs. In addition, guiding vanes 40, which are fixed to a stator 42 of the gas turbine 10, may be disposed between the stages of annular arrays of turbine blades 38. Between the exit of the combustion chamber 28 and the leading turbine blades 38 inlet guiding vanes 44 may be provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimize the angle of the combustion or working gas on the turbine blades 38.

The turbine section 18 drives the compressor section 14. The compressor section 14 comprises an axial series of vane stages 46 and rotor blade stages 48. The rotor blade stages 48 may comprise a rotor disc supporting an annular array of blades. The compressor section 14 may also comprises a casing 50 that surrounds the rotor stages and supports the vane stages 48. The guide vane stages may include an annular array of radially extending vanes that are mounted to the casing 50. The vanes are provided to present gas flow at an optimal angle for the blades at a given gas turbine operational point. Some of the guide vane stages may have variable vanes, where the angle of the vanes, about their own longitudinal axis, can be adjusted for angle according to air flow characteristics that can occur at different gas turbine operations conditions. The casing 50 may define a radially outer surface 52 of the passage 56 of the compressor 14. A radially inner surface 54 of the passage 56 may be at least partly defined by a rotor drum 53 of the rotor which may be partly defined by the annular array of blades 48.

The present technique is described with reference to the above exemplary gas turbine having a single shaft or spool connecting a single, multi-stage compressor and a single, one or more stage turbine. However, it should be appreciated that the present technique is equally applicable to two or three shaft gas turbines and which can be used for industrial, aero or marine applications.

The terms upstream and downstream refer to the flow direction of the airflow and/or working gas flow through the gas turbine unless otherwise stated. The terms forward and rearward refer to the general flow of gas through the gas turbine. The terms axial, radial and circumferential are made with reference to the rotational axis 20 of the gas turbine, unless otherwise specified.

Figure 2A:
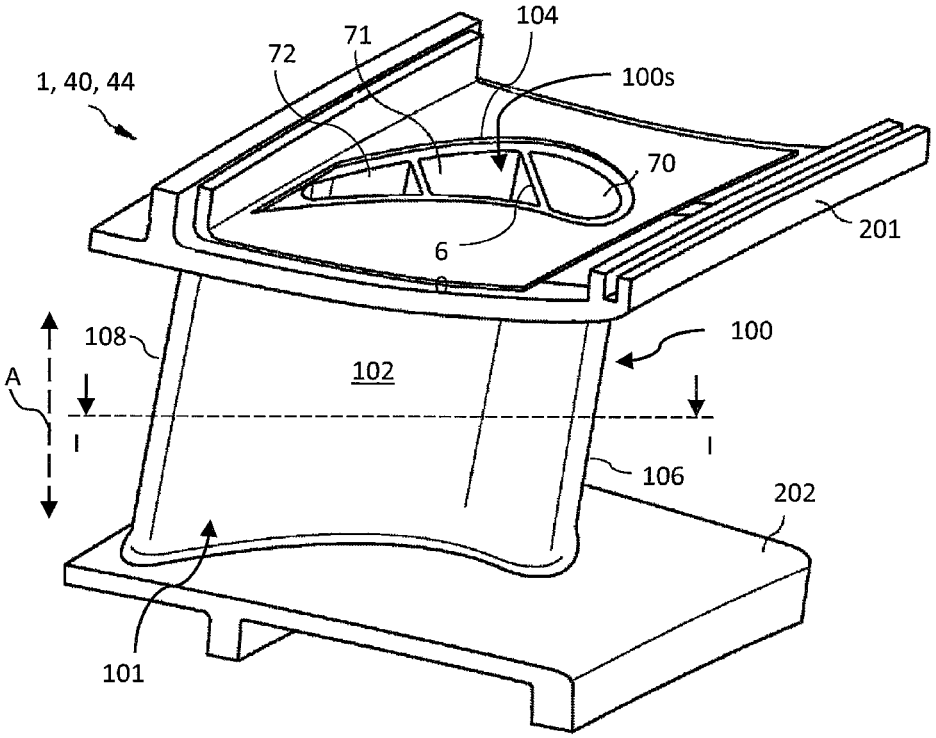
FIG. 2A is a perspective view illustrating an exemplary embodiment of a turbomachine component according to the present technique, exemplified by a vane in accordance with the present technique.
Figure 2B:
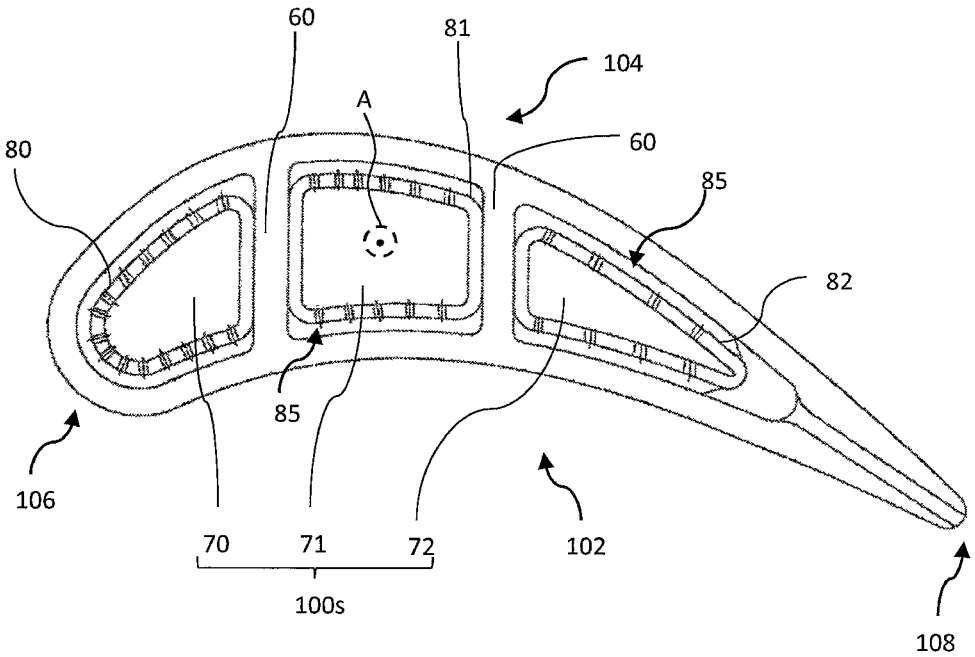
FIG. 2B is a cross-sectional view along the line I-I in FIG. 2A.

In the present technique, a turbomachine component 1 including an airfoil 100 is presented—as shown for example in FIGS. 2A and 2B. The turbomachine component 1 of the present technique may be the vane 40,44 of the gas turbine 10, described hereinabove, unless other specified. The turbomachine component 1 of the present technique may be the blade 38 of the gas turbine 10, described hereinabove, unless other specified. Hereinafter, for sake of simplicity and brevity and not intended to be a limitation unless otherwise specified, the turbomachine component 1 has been exemplified, and has also been referred to, as a vane of the gas turbine, however it may be noted that the turbomachine component 1 according to the present technique may also be another turbomachine component 1 that includes an airfoil in accordance with the present technique.

FIGS. 2A and 2B schematically depict an example of a turbomachine component 1, exemplified by a vane 40, 44 of the gas turbine.

The turbomachine component 1 may include a platform 201, i.e. a first platform 201, another platform 202, i.e. a second platform 201, and an airfoil 100 extending between the platforms 201 and 202. The platforms 201, 202 may extend circumferentially, when installed in the gas turbine 10.

The airfoil 100 includes an airfoil wall 101. The airfoil wall 101 may include a pressure side 102 (also referred to as pressure surface or concave surface/side) and a suction side 104 (also referred to as suction side or convex surface/side). The pressure side 102 and the suction side 104 meet each other at a leading edge 106 and a trailing edge 108 of the airfoil 100.

A direction of extension of the airfoil 100 between the platforms 201 and 202 may represent a longitudinal direction A of the airfoil 100. Generally, the longitudinal direction A of the airfoil 100 may be understood as span-wise direction of the airfoil 100.

The airfoil wall 101 defines an internal space 100*s* of the airfoil 100. More precisely, the pressure side 102, the suction side 104, the leading edge 106 and the trailing edge 108 define an internal space 100*s* of the airfoil 100. The internal space 100*s* of the airfoil 100 may further be limited by the platforms 201, 202.

At least one web 60 may be disposed within the internal space 100*s* of the airfoil 100. The web 60 may extend between the pressure side 102 and the suction side 104. More precisely, each web 60 may extend between an inner surface of the airfoil wall 101 at the pressure side 102 of the airfoil 100 and an inner surface of the airfoil wall 101 at the suction side 104 of the airfoil 100. It may be noted that although the example of FIGS. 2A and 2B show two such webs 60, for exemplary purposes, the airfoil 100 may have 1 or 3 or more webs 60. Each of the webs 60 may be connected to the pressure side 102 and the suction side 104. More precisely, each of the webs 60 may be connected to the inner surface of the pressure side section of the airfoil wall 101 and the inner surface of the suction side section of the airfoil wall 101.

The wall of the airfoil 100 that includes the pressure side 102 and the suction side 104 and defines the leading edge 106 and the trailing edge 108 may also be referred to as the external wall of the airfoil 100 or as primary wall of the airfoil 100 and has been referred to as the airfoil wall 101 in the present technique. The primary wall of the airfoil 100 defines the external appearance of the airfoil, or in other words defines the airfoil shape.

Each of the web 60 may also be understood as formed by a wall, however the wall forming the web 60 is different than the primary wall i.e. is different than the airfoil wall 101, and may be referred to as internal wall or secondary wall of the airfoil 100. The web 60 may be understood to be surrounded completely be the airfoil wall 101 of the airfoil 100.

As shown in the examples of FIGS. 2A and 2B, the internal space 100*s* of the airfoil 100 may include a plurality of cooling channels 70, 71, 72 for flow of cooling air 5 therethrough—e.g. a first cooling channel 71 and a second cooling channel 72 which may be disposed adjacent to each other. The cooling channels 70, 71, 72 may be understood as sub-divisions of the internal space 100*s* of the airfoil 100 created by the webs 60.

It may be noted that although the example of FIG. 2B shows three such cooling channels 70, 71, 72 for exemplary purposes, the airfoil 100 may have 1 or 2 or 4 or more cooling channels. The cooling air 5 may be provided into one or more of the cooling channels 70, 71 from outside the airfoil 100, for example by cooling air flow paths (not shown) formed through the platforms 201, 202. Alternatively, or in addition to the above, the cooling air 5 may be provided into the cooling channel, e.g. into the second cooling channel 72, from another cooling channel 71, i.e. the first cooling channel 71, of the airfoil 100. In short, cooling air 5 may enter the first cooling channel 71 via an inlet of the first cooling channel 71, then flow into the first cooling channel 71 substantially along the longitudinal direction A of the airfoil 100, and then may make a U-turn and then enter into the second cooling channel 72, and then flow into the second cooling channel 71 substantially along the longitudinal direction A of the airfoil 100. It may be noted that in such a flow scheme a flow direction of the cooling air flowing in the first cooling channel 71 substantially along the longitudinal direction A of the airfoil 100, may be opposite to a flow direction of the cooling air flowing in the second cooling channel 72 substantially along the longitudinal direction A of the airfoil 100.

The cooling channels may extend along the longitudinal direction A of the airfoil 100, as shown in the examples of FIG. 2A. As shown in the example of FIGS. 2A and 2B, each cooling channel 70, 71, 72 may be defined by one or more of the webs 60 and the pressure side 102 and the suction side 104. The example of FIGS. 2A and 2B shows a leading-edge cooling channel 70 defined by one of the webs 60, a part of the pressure side 102, a part of the suction side 104 and the leading edge 106. The example of FIG. 2B also shows a second cooling channel 72 defined by one of the webs 60, a part of the pressure side 102, a part of the suction side 104 and the trailing edge 108. Furthermore, the example of FIG. 2B shows a first cooling channel 71 defined by two adjacent webs 60 facing each other, a part of the pressure side 102, and a part of the suction side 104.

As shown in the example of FIG. 2B, which schematically represents cross-section of the turbomachine component 1 along the line I-I in FIG. 2A, the airfoil 100 may further include a plurality of impingement inserts 80, 81, 82 (hereinafter also referred to as inserts) inserted in the cooling channels 70, 71, 72, respectively, although not depicted in the example of FIG. 2A. As shown in FIG. 2B, each impingement insert 80, 81, 82 may include one or more impingement holes 85 for ejecting impingement jets 86 (shown in FIGS. 3A and 3B) of cooling air 5 towards the pressure side 102 and/or the suction side 104 of the airfoil 100 and/or towards the leading edge 106 and/or towards the trailing edge 108 of the airfoil 100 for the purpose of cooling.

The impingement inserts may generally be understood as a component inserted in the cooling channel that includes one or more impingement holes for ejecting impingement jets of cooling air towards the inner surface of the airfoil wall, preferably towards the pressure side 102 and/or the suction side 104 of the airfoil 100 and/or towards the leading edge 106 and/or towards the trailing edge 108 of the airfoil 100 for the purpose of impinging onto the inner surface of the airfoil 100 to provide cooling to the inner surface of the airfoil 100.

Figure 3A:
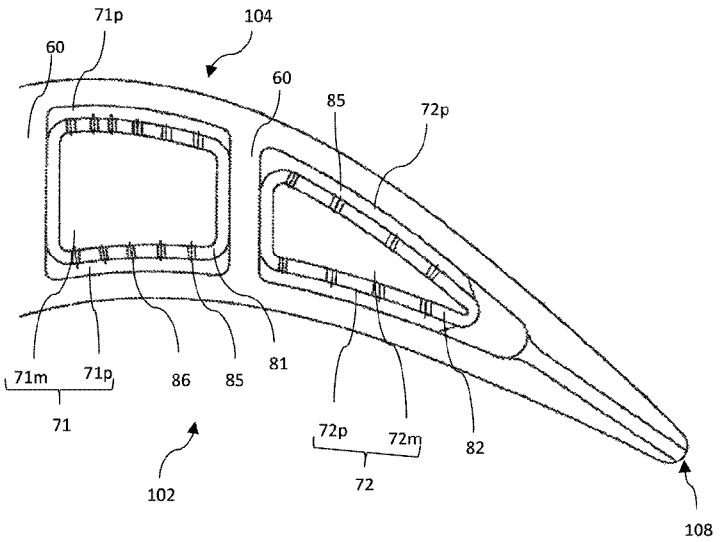
FIG. 3A schematically represents an exemplary embodiment of the turbomachine component according to the present technique.
Figure 3B:
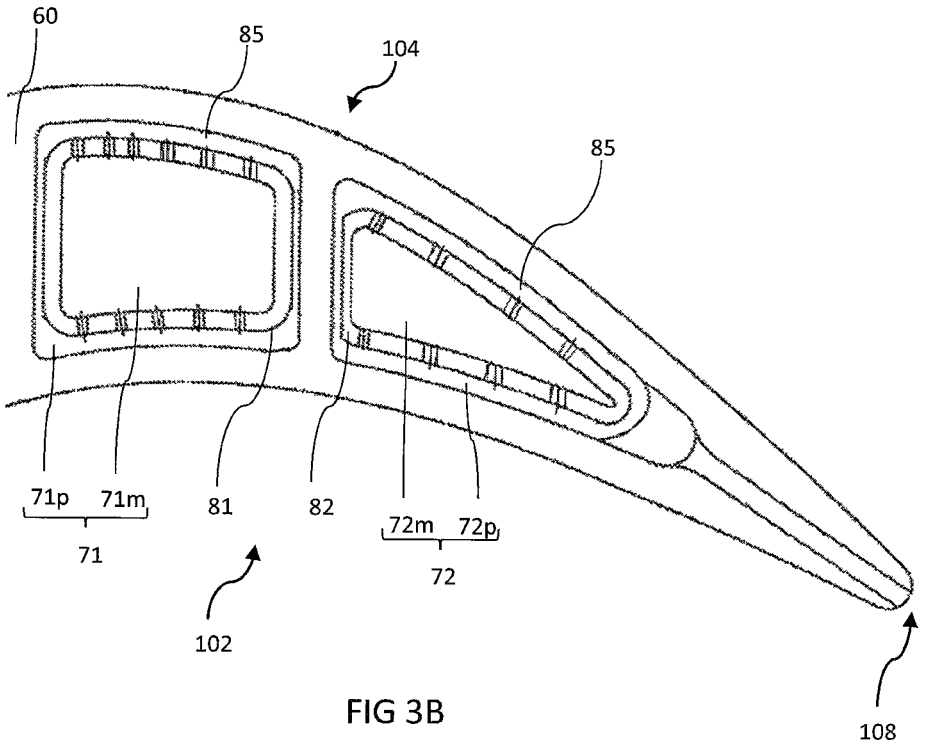
FIG. 3B schematically represents another exemplary embodiment of the turbomachine component according to the present technique.

As shown in FIG. 2B, and also in FIGS. 3A and 3B, the turbomachine component 1 includes a first impingement insert 81 (hereinafter also referred to as the first insert 81) inserted in the first cooling channel 71. The first insert 81 defines, within the first cooling channel 71, a first main flow channel 71*m* and at least one first peripheral flow channel 71*p*. In other words, the first insert 81 divides the first cooling channel 71 into a first main flow channel 71*m* and at least one first peripheral flow channel 71*p*. The one first peripheral flow channel 71*p* is created by positioning the first insert 81 spaced apart from the pressure side 102 and/or the suction side 104, thereby creating the first peripheral flow channel 71*p* thereinbetween.

Depending on the number and/or placement of the inserts inserted in a given cooling channel the number of peripheral and/or main flow channels may differ. For example, as shown in FIG. 3B, the first insert 81 is positioned to be spaced apart from the pressure side 102, the suction side 104, and the webs 60, thereby defining one first main flow channel 71*m* and one first peripheral flow channel 71*p* disposed peripherally around the first main flow channel 71*m*. One or both sides of the first insert 81 facing the webs 60 may also include impingement holes. Alternatively, as shown in FIG. 2B and FIG. 3A, the first insert 81 is positioned to be spaced apart from the pressure side 102 and the suction side 104, however is in contact with the webs 60, thereby defining one first main flow channel 71*m* and two first peripheral flow channel 71*p* disposed peripherally around the first main flow channel 71*m*.

The first main flow channel 71*m* conducts flow of cooling air 5 along the longitudinal direction A of the airfoil 100. The at least one first peripheral flow channel 71*p* receives impingement jets 86 ejected from the first main flow channel 71*m* via the impingement holes 85 of the first impingement insert 81. The impingement jets 86 may be directed to the airfoil wall 101.

The turbomachine component 1 may include a second impingement insert 82 (hereinafter also referred to as the second insert 82) inserted in the second cooling channel 72. The second impingement insert 82 defines, within the second cooling channel 72, a second main flow channel 72*m* and at least one second peripheral flow channel 72*p*. In other words, the second impingement insert 82 divides the second cooling channel 72 into a second main flow channel 72*m* and at least one second peripheral flow channel 72*p*. The one second peripheral flow channel 72*p* is created by positioning the second insert 82 spaced apart from the pressure side 102 and/or the suction side 104, thereby creating the second peripheral flow channel 72*p* thereinbetween.

Depending on the number and/or placement of the inserts inserted in a given cooling channel the number of peripheral and/or main flow channels may differ. For example, as shown in FIG. 3B, the second insert 82 is positioned to be spaced apart from the pressure side 102, the suction side 104, the web 60, and the trailing edge 108 thereby defining one second main flow channel 72*m* and one second peripheral flow channel 72*p* disposed peripherally around the second main flow channel 72*m*. The side of the second insert 82 facing the web 60 and/or the side of the second insert 82 facing the trailing edge 108 may also include impingement holes. Alternatively, as shown in FIG. 2B and FIG. 3A, the second insert 82 is positioned to be spaced apart from the pressure side 102 and the suction side 104, however is in contact with the web 60 and the trailing edge 108, thereby defining one second main flow channel 72*m* and two second peripheral flow channels 72*p* disposed peripherally around the second main flow channel 72*m*.

The second main flow channel 72*m* conducts flow of cooling air 5 along the longitudinal direction A of the airfoil 100. The at least one second peripheral flow channel 72*p* receives impingement jets 86 ejected from the second main flow channel 72*m* via impingement holes 85 of the second impingement insert 82. The impingement jets 86 may be directed to the airfoil wall 101.

Figure 4A:
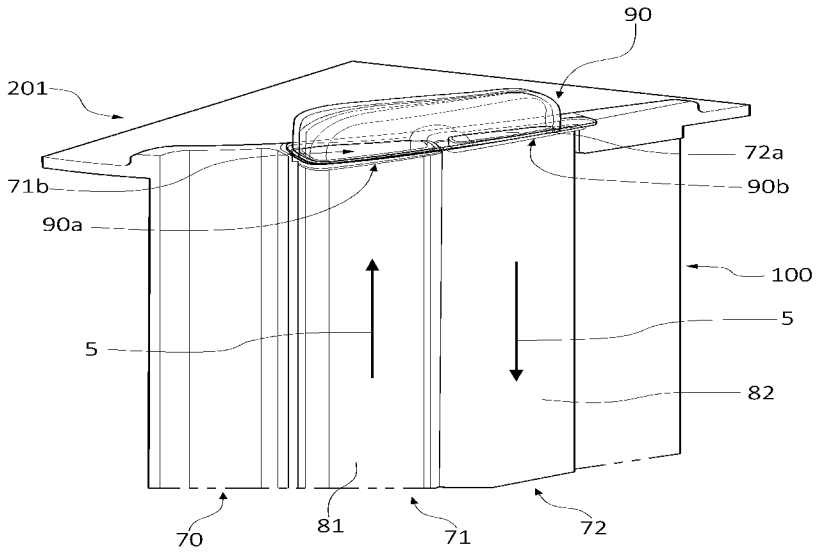
FIG. 4A schematically represents a channel connecting conduit according to the present technique.
Figure 4B:
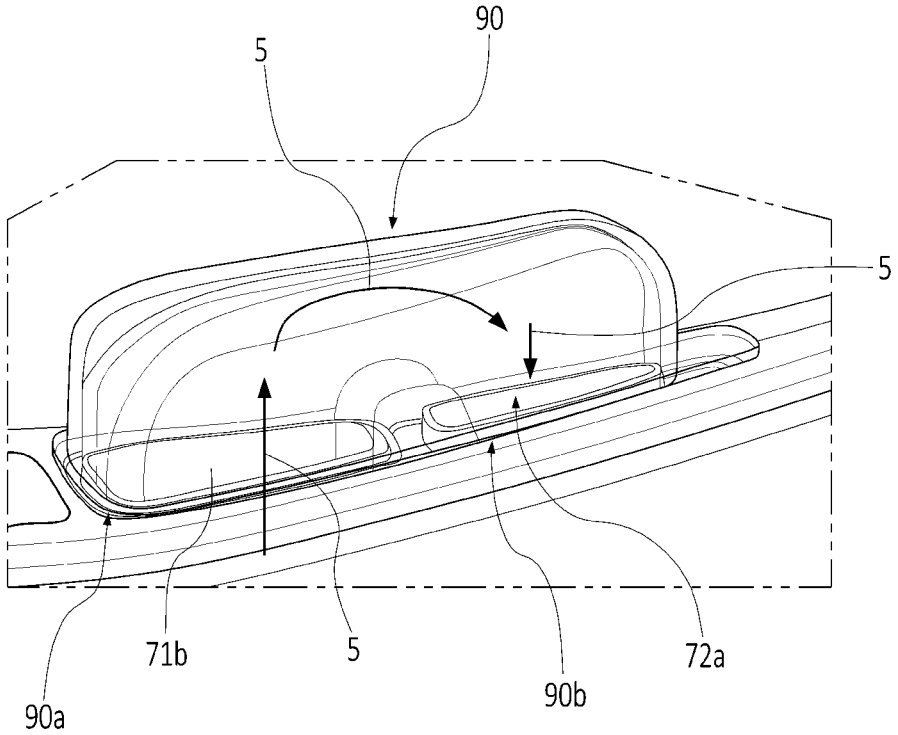
FIG. 4B schematically represents an enlarged view of the channel connecting conduit according to the present technique.

As shown in FIGS. 4A and 4B, the turbomachine component 1 includes a channel connecting conduit 90 configured to conduct a flow of the cooling air 5 from the first cooling channel 71 to the second cooling channel 72. The channel connecting conduit 90 includes an inlet 90*a* connected to an outlet 71*b* of the first cooling channel 71. The channel connecting conduit 90 includes an outlet 90*b* connected to an inlet 72*a* of the second cooling channel 72. An inlet (not shown) of the first cooling channel 71, and outlet (not shown) of the second cooling channel 72 may be located on the other side of the airfoil in the direction A. This enables reusing of cooling air in the second cooling channel 72 which has been used in the first cooling channel 71.

Hereinafter with reference to FIGS. 5A and 5B, another aspect of the present technique has been explained.

Figure 5A:
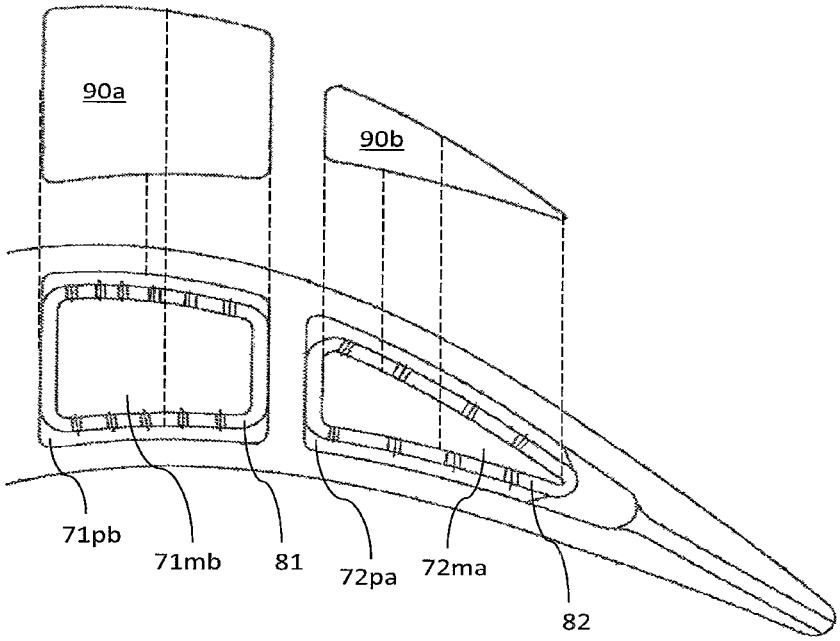
FIG. 5A schematically represents relation between an inlet and an outlet of the channel connecting conduit with a first and a second cooling channel, according to the present technique.
Figure 5B:
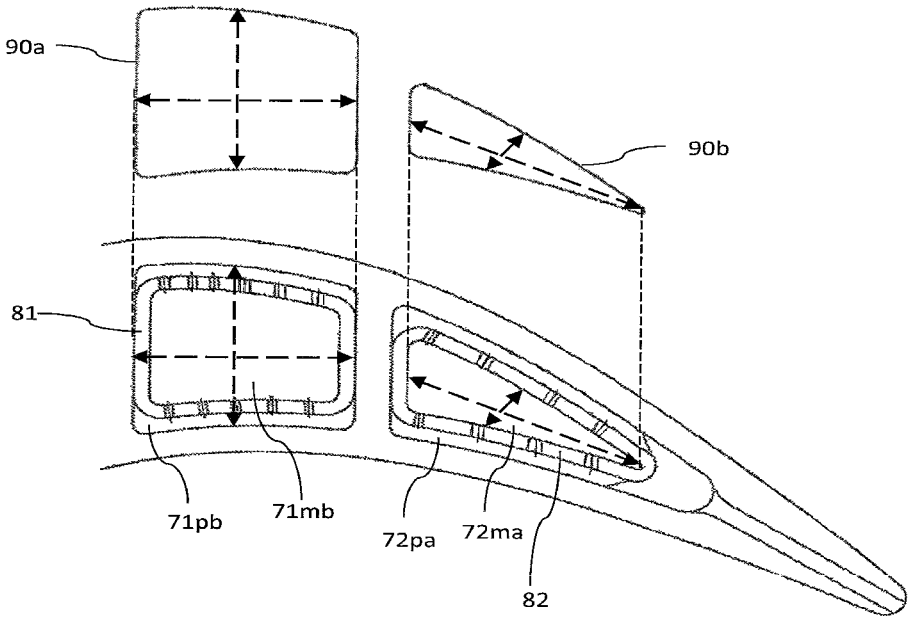
FIG. 5B is another schematic representation depicting the relation between the inlet and the outlet of the channel connecting conduit with the first and the second cooling channel, according to the present technique.

As shown in FIGS. 5A and 5B, the first main flow channel 71*m* may be disposed at an inner side of the first impingement insert 81. The first main flow channel 71*m* may include a first main flow channel outlet 71*mb*. The first main flow channel 71*m* may include an inlet (not shown) formed on another side (in direction A) of the airfoil. The cooling air enters the first main flow channel 71*m* through the inlet and flows substantially along direction A towards the first main flow channel outlet 71*mb*. While flowing, from the inlet of the first main flow channel 71*m* towards the first main flow channel outlet 71*mb* within the first main flow channel 71*m*, the cooling air encounters the impingement holes 85 and some of the cooling air, i.e. a part of the cooling air, is ejected out of the impingement holes 85 into the first peripheral flow channel 71*p* in form of impingement jets 86 via the impingement holes 85. The remaining cooling air, i.e. the cooling air that has not been ejected out as impingement jets, continues and reaches the first main flow channel outlet 71*mb*.

As shown in FIGS. 5A and 5B, the at least one first peripheral flow channel 71*p* includes a first peripheral flow channel outlet 71*pb*. The cooling air ejected from the impingement jets into the first peripheral flow channel 71*p* flows into the first peripheral flow channel 71*p* towards the first peripheral flow channel outlet 71*pb*. The first peripheral flow channel outlet 71*pb* may be disposed towards the outlet 71*b* of the first cooling channel 71. The first peripheral flow channel 71*p* may include an inlet (not shown) on another side (in direction A) of the airfoil. Alternatively, the inlet of the first peripheral flow channel 71*p* may be closed or sealed, so that the only way of cooling air flowing into the first peripheral flow channel 71*p* is through impingement jets 86. In other words, the first peripheral flow channel 71*p* may have only one opening, besides the impingement holes 85, that fluidly communicated with an outside of the first peripheral flow channel 71*p*—this one opening may be first peripheral flow channel outlet 71*pb*.

The cooling air in the first peripheral flow channel 71*p*, e.g. ejected from the impingement jets 86 into the first peripheral flow channel 71*p*, flows into the first peripheral flow channel 71*p* towards the first peripheral flow channel outlet 71*pb*.

Figure 6:
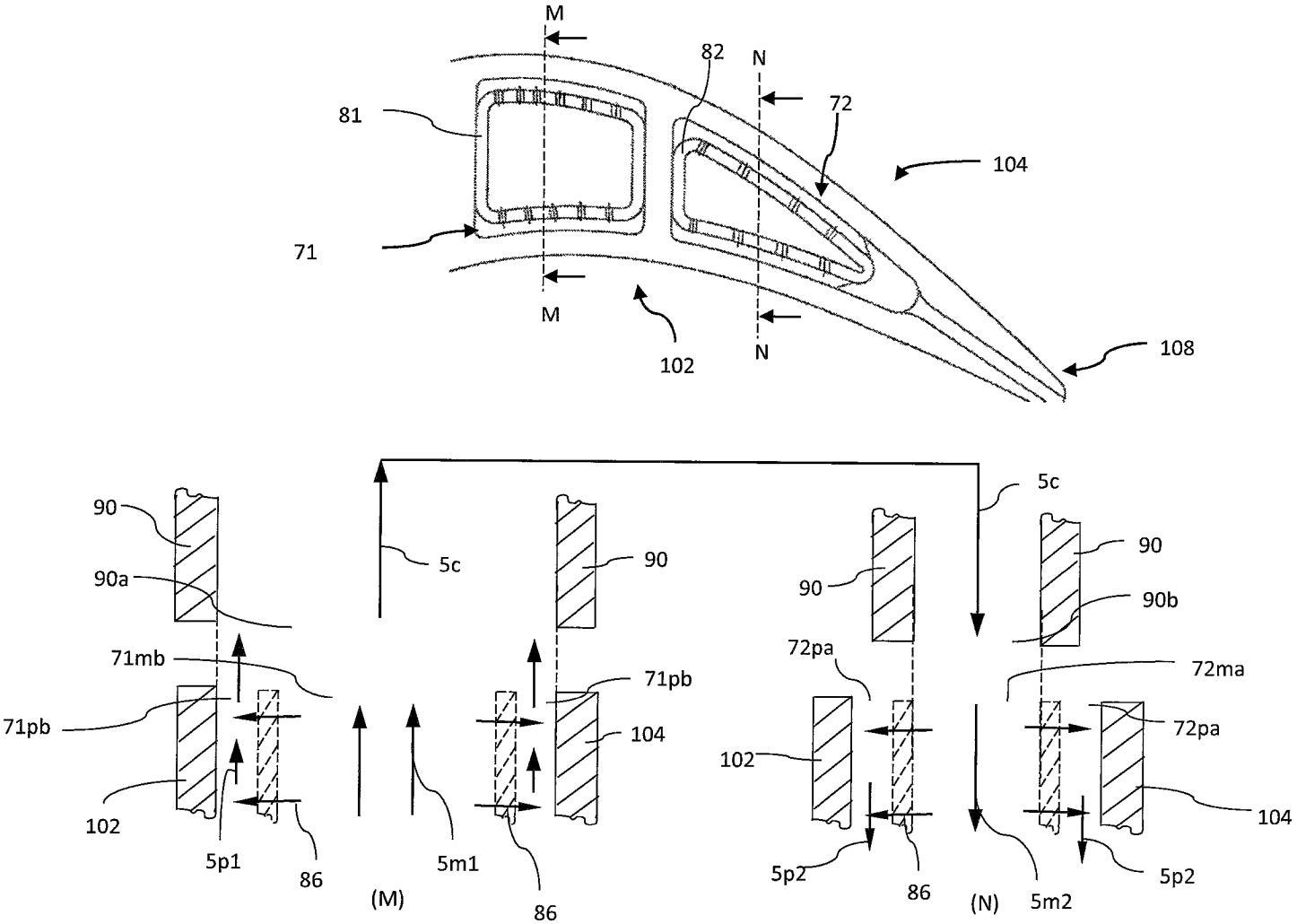
FIG. 6 schematically illustrates working of the present technique.

As schematically depicted in FIGS. 5A and 5B (with help of dotted lines), the inlet 90*a* of the channel connecting conduit 90 may encompasses or cover each of the outlet 71*mb* of the first main flow channel 71*m* and the outlet 71*pb* of the first peripheral flow channel 71*p*. In other words, the cooling air 5 flowing out of the outlet 71*mb* of the first main flow channel 71*m* and the outlet 71*pb* of the first peripheral flow channel 71*p* flow into the inlet 90*a* of the channel connecting conduit 90. FIG. 6 part M shows cooling air 5*p*1 flowing in the first peripheral flow channel 71*p* and flowing out of the outlet 71*pb* of the first peripheral flow channel 71*p*, as well as cooling air 5*m*1 flowing in the first main flow channel 71*m* and flowing out of the outlet 71*mb* of the first main flow channel 71*m*—both the cooling air 5*p*1 and the cooling air 5*m*1 flow into the inlet 90*a* of the channel connecting conduit 90.

According to the present technique, and as depicted in FIGS. 5A and 5B, the outlet 90*b* of the channel connecting conduit 90 may encompass an inlet 72*ma* of the second main flow channel 72*m* without encompassing an inlet 72*pa* of the second peripheral flow channel 72*p*, as also shown in FIG. 6 part N. In other words, as shown in FIG. 6 part N, the cooling air 5 flowing from the outlet 71*mb* of the first main flow channel 71*m* and the outlet 71*pb* of the first peripheral flow channel 71*p* into the inlet 90*a* of the channel connecting conduit 90 may flow, via the channel connecting conduit 90 in form of cooling air 5*c*, only into the inlet 72*ma* of the second main flow channel 72*m*.

As shown in FIG. 6 part N, the cooling air 5 flowing from the outlet 71*mb* of the first main flow channel 71*m* and the outlet 71*pb* of the first peripheral flow channel 71*p* into the inlet 90*a* of the channel connecting conduit 90 may not flow, via the channel connecting conduit 90, into the inlet 72*pa* of the second peripheral flow channel 72*p*.

As shown in FIG. 6 part M (in FIG. 6 part marked 'M' is cross-section at the line M-M shown in the airfoil in the upper part of the FIG. 6) and FIG. 6 part N (in FIG. 6 part marked 'N' is cross-section at the line N-N shown in the airfoil in the upper part of the FIG. 6), according to an aspect of the present technique, the inlet 90*a* of the channel connecting conduit 90 may be connected to both the outlet 71*mb* of the first main flow channel 71*m* and the outlet 71*pb* of the first peripheral flow channel 71*p* so as to receive the cooling air 5*m*1 and 5*p*1 from both the first main flow channel 71*m* and the first peripheral flow channel 71*p*, however the outlet 90*b* of the channel connecting conduit 90 may be connected only to the inlet 72*ma* of the second main flow channel 72*m*, so as to deliver or feed the cooling air 5*c*, received from both the first main flow channel 71*m* and the first peripheral flow channel 71*p*, into only the second main flow channel 72*m*, and not into the second peripheral flow channel 72*p*.

Hereinafter with reference to FIGS. 8 and 9, another aspect of the present technique has been explained.

Figure 8:
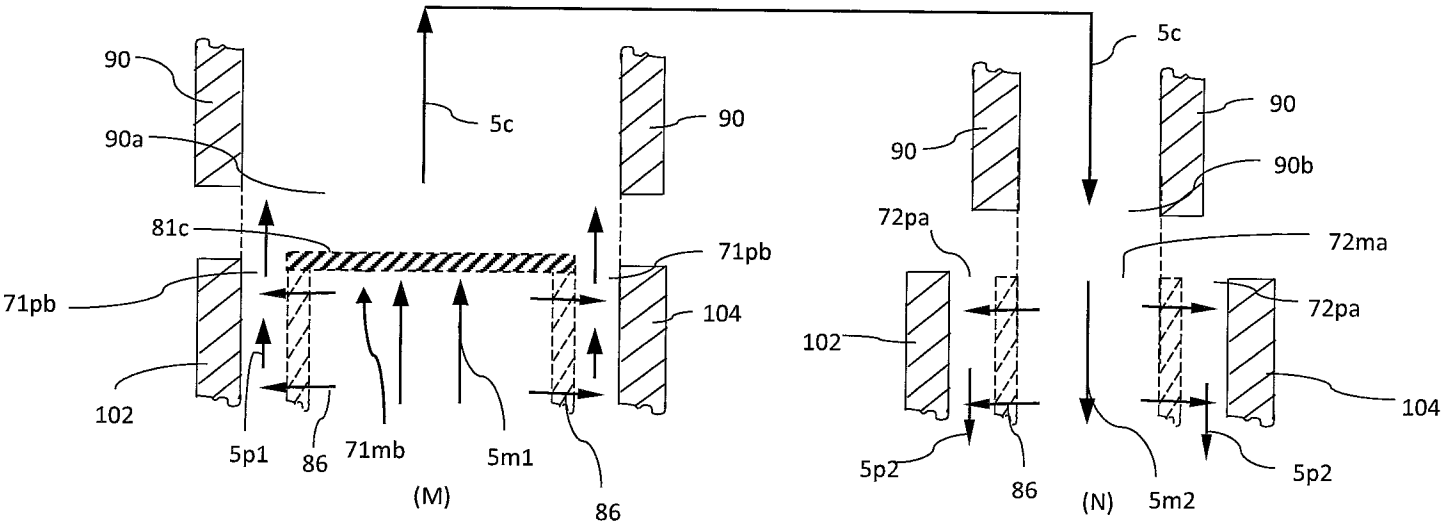
FIG. 8 schematically represents an exemplary embodiment of the turbomachine component according to the present technique wherein an outlet of the first main flow channel is completely sealed.

As shown in FIG. 8, the outlet 71*mb* of the first main flow channel 71*m* may be sealed, e.g. completely sealed, for completely stopping flow of cooling air 5*m*1 out of the outlet 71*mb* of the first main flow channel 71*m* into the channel connecting conduit 90. The sealing may be achieved by a sealing cap 81*c*. In an embodiment (not shown), the sealing cap 81*c* may be disposed inside the first main flow channel 71*m*. Alternatively, as shown in FIG. 8, the sealing cap 81*c* may be disposed at the outlet 71*mb* of the first main flow channel 71*m* inside or outside the first main flow channel 71*m*.

Alternatively (not shown) the outlet 71*mb* of the first main flow channel may be partially sealed for partially stopping flow of cooling air 5*m*1 out of the outlet 71*mb* of the first main flow channel 71*m* into the channel connecting conduit 90. The partial sealing may be achieved by a sealing cap (not shown) which partially blocks the first main flow channel 71*mb*. The sealing cap may be disposed inside the first main flow channel 71*m* or at the outlet 71*mb* of the first main flow channel 71*m* inside or outside the first main flow channel 71*m*.

Figure 9:
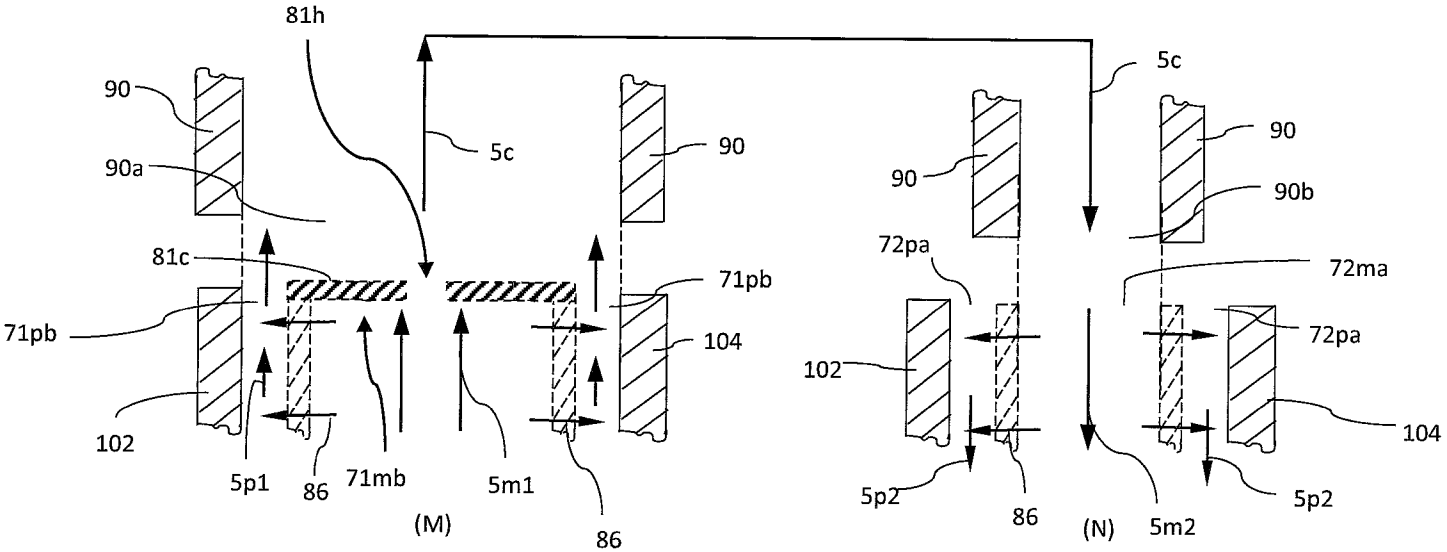
FIG. 9 schematically represents another exemplary embodiment of the turbomachine component according to the present technique wherein an outlet of the first main flow channel is partially sealed; in accordance with aspects of the present technique.

As shown in FIG. 9, the outlet 71*mb* of the first main flow channel 71*m* may be sealed, e.g. partially sealed, for partially stopping flow of cooling air 5*m*1 out of the outlet 71*mb* of the first main flow channel 71*m* into the channel connecting conduit 90. The partial sealing may be achieved by a sealing cap 81*c* comprising one or more through holes 81*h*. The sealing cap 81*c* may be disposed inside the first main flow channel 71*m* or at the outlet of the first main flow channel 71*mb* inside or outside the first main flow channel 71*m*. The one or more through-holes 81*h* allow flow of cooling air 5*m*1 of the first main flow channel 71*m* into the channel connecting conduit 90.

The sealing cap 81*c*, with or without the through holes 81*h*, functions to build up pressure inside the first main flow channel 71*m* to facilitate formation of the impingement jets ejected from the first main flow channel 71*m* via impingement holes of the first impingement insert.

As a result of the sealing as depicted in FIG. 8, all of the cooling air which enters the first main flow channel 71*m* is ejected out of the impingement holes 85 into the first peripheral flow channel 71*p* in form of impingement jets 86 via the impingement holes 85. Then, all of the cooling air flows into the channel connecting conduit 90 via the outlet 71*pb* of the first peripheral flow channel 71*p* and is then introduced into the second peripheral flow channel 72*p*.

As a result of the sealing as depicted in FIG. 9, a part of the cooling air which enters the first main flow channel 71*m* is ejected out of the impingement holes 85 into the first peripheral flow channel 71*p* in form of impingement jets 86 via the impingement holes 85 and remaining part of the cooling air is ejected out of the one or more through hole 81*h*. Then, the cooling air flows into the channel connecting conduit 90 via the outlet 71*pb* of the first peripheral flow channel 71*p* and via the one or more through hole 81*h* of the sealing cap 81*c*, and is then introduced into the second peripheral flow channel 72*p*.

The inlet 72*pa* of the second peripheral flow channel 72*p* may be sealed. For example, as shown in FIG. 7, a flange 82*p* protruding out of an outer surface of the second impingement insert 82 may be configured to close or to seal the inlet 72*pa* of the second peripheral flow channel 72*p*.

As shown in FIG. 4A, in the turbomachine component 1, the inlet 90*a* and the outlet 90*b* of the channel connecting conduit 90, the outlet 71*b* of the first cooling channel 71, and the inlet 72*a* of the second cooling channel 72 may be arranged at the platform 201. Alternatively (not depicted), in the turbomachine component 1, the inlet 90*a* and the outlet 90*b* of the channel connecting conduit 90, the outlet 71*b* of the first cooling channel 71, and the inlet 72*a* of the second cooling channel 72 may be arranged at the platform 202 (shown in FIG. 2A). Optionally, the turbomachine component 1 may have two channel connecting conduits 90—one each at the platform 201 and the platform 202.

Figure 7:
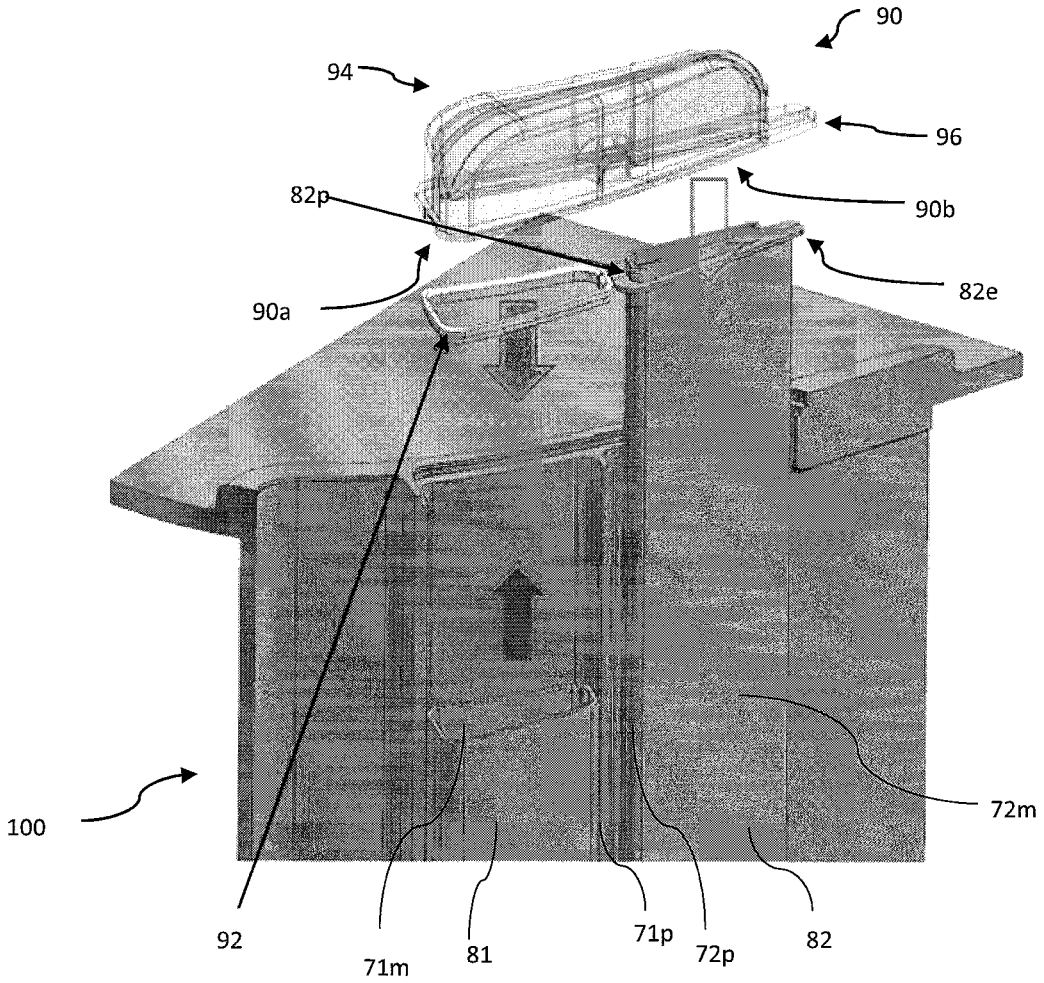
FIG. 7 schematically illustrates further aspects of exemplary embodiments of the turbomachine component of the present technique, and also schematically illustrates an exemplary embodiment showing a method for assembling the channel connecting conduit with the first and the second cooling channel.

As shown in FIG. 7, the turbomachine component 1 may include a seal ring 92 configured to be positioned between the inlet 90*a* of the channel connecting conduit 90 and the outlet 71*b* of the first cooling channel 71. The seal ring 92 may be a gasket that makes the coupling between the outlet 71*b* of the first cooling channel 71 and the inlet 90*a* of the channel connecting conduit 90 airtight so as to obviate or reduce any leakages of air. Alternatively, or in addition to above, the turbomachine component 1 may include another seal ring (not shown) configured to be positioned between the outlet 90*b* of the channel connecting conduit 90 and the inlet 72*a* of the second cooling channel 72. The seal ring may be a gasket that makes the coupling between the inlet 72*a* of the second cooling channel 72 and the outlet 90*b* of the channel connecting conduit 90 airtight so as to obviate or reduce any leakages of air.

As shown in FIGS. 4A, 4B and 7, the channel connecting conduit 90 may include a bent portion 94 having a U-shape between the inlet 90*a* and the outlet 90*b* of the channel connecting conduit 90. The cooling air 5 received into the inlet 90*a* of the channel connecting conduit 90 may flow out only from the outlet 90*b* of the channel connecting conduit 90, i.e. the bent portion 94 may not have any by-pass passages formed therein. The bent portion 94 may gradually decrease in inner volume (i.e. a cross-sectional area of the air flow path defined in the channel connecting conduit 90 gradually decreases) from the inlet 90*a* to the outlet 90*b*. The bent portion 94 may have smoother bending edges i.e. curved parts that implement change in flow direction of the air within the channel connecting conduit 90.

As shown in FIG. 7, the channel connecting conduit 90 may include an extension portion 96 extending horizontally from the outlet 90*b* of the channel connecting conduit 90 in a direction opposite to the inlet 90*a* of the channel connecting conduit 90. The second impingement insert 82 may include a receiving portion 82*e*. The receiving portion 82*e* may have a shape corresponding to or complementary to the extension portion 96. The receiving portion 82*e* and the extension portion 96 may be mechanically coupled to each other, for example by brazing.

The extension portion 82*e* and the flange 82*p* may be integrally formed i.e. one surface of the flange 82*p* may function to seal the inlet 72*pa* whereas other surface may act to mechanically couple the extension portion 96.

As shown in FIGS. 2A to 7, the second cooling channel 72 may be located at the trailing edge 108 of the airfoil 100. The first cooling channel 71 may be located between the leading edge 106 of the airfoil 100 and the trailing edge 108 of the airfoil 100, with respect to a camber line (not depicted) of the airfoil 100.

FIG. 7 also depicts a method of assembling the turbomachine component 1 of the present technique.

As shown in FIG. 7, the extension portion 96 of the channel connecting conduit 90 may be mechanically coupled, e.g. brazed, to the receiving portion 82*e* of the second insert 82 while some of the second insert 82 is positioned inside the second cooling channel 72 and some including the receiving portion 82*e* is outside the second cooling channel 72. This helps in holding the second insert in place while the coupling is being performed. Alternatively, the extension portion 96 of the channel connecting conduit 90 may be mechanically coupled, e.g. brazed, to the receiving portion 82*e* of the second insert 82 while the second insert 82 is positioned outside the second cooling channel 72, and then the second insert 82 is inserted into the second cooling channel 72.

In either case, the channel connecting conduit 90 coupled to the second insert 82 is pushed towards the airfoil 100, and the first insert 81 is pushed into the first cooling channel 71 from the other side of the airfoil into the first cooling channel 71 so as to couple the channel connecting conduit 90 to the first insert 81. The seal ring 92 may be placed between the inlet 90*a* of the channel connecting conduit 90 and the outlet 71*b* while the first insert 81 and the channel connecting conduit 90 are pushed into each other.

The turbomachine component 1 may be vane 40, 44 of a gas turbine 10 as shown in FIG. 1.

The turbomachine component 1 may be blade 38 of a gas turbine 10 as shown in FIG. 1.

The present technique also envisions a turbomachine assembly. The turbomachine assembly may include at least one turbomachine component 1 according to the present technique as described hereinabove with respect to FIGS. 2A to 7. An example of the turbomachine assembly may be a vane assembly or a vane stage. The vane assembly or the vane stage may be disposed in the turbine section 18 of the gas turbine 10, e.g. as shown in FIG. 1.

The turbine section 18 may include an inner casing and an outer casing defining thereinbetween at least a section of a hot gas path. The hot gas path may generally be annular in shape. The inner casing may be disposed radially inwards of the outer casing.

The turbomachine component 1 may be a vane 40,44 which is connected to or arranged at the inner and the outer casings. The airfoil 100 of the vane may be disposed in the section of the hot gas path.

The outlet 71*b* of the first cooling channel 71, the inlet 72*a* of the second cooling channel 72 and the channel connecting conduit 90 may be positioned radially inwards of the airfoil 100 at the inner casing.

Alternatively, the outlet 71*b* of the first cooling channel 71, the inlet 72*a* of the second cooling channel 72 and the channel connecting conduit 90 may be positioned radially outwards of the airfoil 100 at the outer casing.

Alternatively, the gas turbine may have at least two channel connecting conduits 90. One, say a first channel connecting conduit 90, of the at least two channel connecting conduits 90, along with the outlet 71*b* of the first cooling channel 71 and the inlet 72*a* of the second cooling channel 72 to which the first channel connecting conduit 90 is connected, may be positioned radially inwards of the airfoil 100 at the inner casing; and another, say a second channel connecting conduit 90, of the at least two channel connecting conduits 90, along with the outlet 71*b* of the first cooling channel 71 and the inlet 72*a* of the second cooling channel 72 to which the second channel connecting conduit 90 is connected, may be positioned radially outwards of the airfoil 100 at the outer casing.

While the present technique has been described in detail with reference to certain embodiments, it should be appreciated that the present technique is not limited to those precise embodiments. Rather, in view of the present disclosure which describes exemplary modes for practicing the invention, many modifications and variations would present themselves, to those skilled in the art without departing from the scope of the appended claims. The scope of the invention is, therefore, indicated by the following claims rather than by the foregoing description. All changes, modifications, and variations coming within the meaning and range of equivalency of the claims are to be considered within their scope.

What is claimed is:

1. A turbomachine component for a gas turbine, the turbomachine component comprising:

an airfoil comprising an airfoil wall defining an internal space of the airfoil, and a first and a second cooling channel in the internal space of the airfoil;

a first impingement insert inserted in the first cooling channel and defining a first main flow channel for conducting flow of cooling air along a longitudinal direction of the airfoil and at least one first peripheral flow channel for receiving impingement jets ejected from the first main flow channel via impingement holes of the first impingement insert, the at least one first peripheral flow channel being formed peripherally around the first main flow channel by positioning the first impingement insert spaced apart from a pressure side and/or a suction side of the airfoil;

a second impingement insert inserted in the second cooling channel and defining a second main flow channel for conducting flow of cooling air along the longitudinal direction of the airfoil and at least one second peripheral flow channel for receiving impingement jets ejected from the second main flow channel via impingement holes of the second impingement insert, the at least one second peripheral flow channel being formed peripherally around the second main flow channel by positioning the second impingement insert spaced apart from the pressure side and/or the suction side of the airfoil; and a channel connecting conduit configured to conduct a flow of the cooling air from the first cooling channel to the second cooling channel and comprising:

an inlet of the channel connecting conduit connected to an outlet of the first cooling channel, and an outlet of the channel connecting conduit connected to an inlet of the second main flow channel of the second cooling channel.

2. The turbomachine component according to claim 1, wherein the inlet of the channel connecting conduit encompasses an outlet of the first peripheral flow channel without encompassing an outlet of the first main flow channel; or wherein the inlet of the channel connecting conduit encompasses each of an outlet of the first main flow channel and an outlet of the first peripheral flow channel.

3. The turbomachine component according to claim 1, wherein an outlet of the first main flow channel comprises a sealing cap for completely stopping flow of cooling air out of the outlet of the first main flow channel into the channel connecting conduit; or wherein an outlet of the first main flow channel comprises a sealing cap and wherein the sealing cap comprises one or more through-holes for conducting flow of cooling air of the first main flow channel into the channel connecting conduit.

4. The turbomachine component according to claim 1, wherein the outlet of the channel connecting conduit encompasses the inlet of the second main flow channel without encompassing an inlet of the second peripheral flow channel.

5. The turbomachine component according to claim 1, wherein an inlet of the second peripheral flow channel is sealed.

6. The turbomachine component according to claim 1, wherein the airfoil wall comprises the pressure side and the suction side meeting at a leading edge and a trailing edge and defining an internal space of the airfoil; and wherein the airfoil comprises at least one web disposed within the internal space of the airfoil and extending between the pressure side and the suction side; and wherein the first cooling channel and/or the second cooling channel is defined by the at least one web and the pressure side and/or the suction side.

7. The turbomachine component according to claim 1, further comprising a platform from which the airfoil extends, and wherein the inlet and the outlet of the channel connecting conduit, the outlet of the first cooling channel, and the inlet of the second cooling channel are arranged at the platform.

8. The turbomachine component according to claim 1, further comprising a seal ring configured to be positioned between the inlet of the channel connecting conduit and the outlet of the first cooling channel.

9. The turbomachine component according to claim 1, wherein the channel connecting conduit comprises a bent portion having a U-shape between the inlet and the outlet of the channel connecting conduit.

10. The turbomachine component according to claim 1, wherein the channel connecting conduit comprises an extension portion extending horizontally from the outlet of the channel connecting conduit in a direction opposite to the inlet of the channel connecting conduit; and wherein the second impingement insert comprises a receiving portion having a shape corresponding to the extension portion, and wherein the receiving portion and the extension portion are configured to be coupled to each other.

11. The turbomachine component according to claim 1, wherein the second cooling channel is located at the trailing edge of the airfoil.

12. The turbomachine component according to claim 1, wherein the turbomachine component is a vane of a gas turbine.

13. A turbomachine assembly comprising a plurality of turbomachine components, wherein the plurality of turbomachine components comprises a turbomachine component according to claim 1.

14. A turbomachine assembly according to claim 13, wherein the inlet of the channel connecting conduit encompasses an outlet of the first peripheral flow channel without encompassing an outlet of the first main flow channel; or wherein the inlet of the channel connecting conduit encompasses each of an outlet of the first main flow channel and an outlet of the first peripheral flow channel.

15. A turbomachine assembly according to claim 13, wherein an outlet of the first main flow channel comprises a sealing cap for completely stopping flow of cooling air out of the outlet of the first main flow channel into the channel connecting conduit; or wherein an outlet of the first main flow channel comprises a sealing cap and wherein the sealing cap comprises one or more through-holes for conducting flow of cooling air of the first main flow channel into the channel connecting conduit.

16. A turbomachine assembly according to claim 13, wherein the airfoil wall comprises a pressure side and a suction side meeting at a leading edge and a trailing edge and defining an internal space of the airfoil; and wherein the airfoil comprises at least one web disposed within the internal space of the airfoil and extending between the pressure side and the suction side; and wherein the first cooling channel and/or the second cooling channel is defined by the at least one web and the pressure side and/or the suction side.

17. A turbomachine assembly according to claim 13, further comprising a platform from which the airfoil extends, and wherein the inlet and the outlet of the channel connecting conduit, the outlet of the first cooling channel, and the inlet of the second cooling channel are arranged at the platform.

18. A turbomachine assembly according to claim 13, wherein the channel connecting conduit comprises an extension portion extending horizontally from the outlet of the channel connecting conduit in a direction opposite to the inlet of the channel connecting conduit; and wherein the second impingement insert comprises a receiving portion having a shape corresponding to the extension portion, and wherein the receiving portion and the extension portion are configured to be coupled to each other.

19. A gas turbine comprising a turbomachine assembly, wherein the turbomachine assembly is according to claim 13.

20. The gas turbine according to claim 19, wherein a turbine section of the gas turbine comprises an inner casing and an outer casing defining thereinbetween at least a section of a hot gas path, the inner casing disposed radially inwards of the outer casing;

wherein the turbomachine component is a vane and connected to the inner and the outer casings and disposed in the section of the hot gas path; and wherein the outlet of the first cooling channel, the inlet of the second cooling channel and the channel connecting conduit are positioned radially inwards of the airfoil at the inner casing or the outlet of the first cooling channel, the inlet of the second cooling channel and the channel connecting conduit are positioned radially outwards of the airfoil at the outer casing.

* * * * *